US006015262A

United States Patent [19]

Huang

[11] Patent Number: 6,015,262

[45] Date of Patent: Jan. 18, 2000

[54] ELECTRIC FAN APPARATUS CAPABLE OF BLOWING AIR IN A DESIRED ORIENTATION

[76] Inventor: Kuo-Cheng Huang, No. 17, Hsin-Ren Rd., Tainan, Taiwan

[21] Appl. No.: 08/955,129

[22] Filed: Oct. 21, 1997

[51] Int. Cl.[7] ..... F01D 25/00

[52] U.S. Cl. ..... 416/100; 416/110; 416/170 R; 416/170 C; 416/246; 416/247 R; 403/344; 417/360; 417/423.15; 417/423.14

[58] Field of Search ..... 416/100, 110, 416/170 R, 170 C, 246, 247 R; 403/344; 417/360, 423.15, 423.14

[56] References Cited

U.S. PATENT DOCUMENTS

| | | | |
|---|---|---|---|
| 2,517,415 | 8/1950 | Preston | 416/100 |
| 2,813,673 | 11/1957 | Smith | 416/423.15 |
| 2,900,127 | 8/1959 | Smith | 417/423.15 |
| 3,625,633 | 12/1971 | Nelson | 416/100 |
| 5,800,126 | 9/1998 | Tsai | 416/100 |

FOREIGN PATENT DOCUMENTS

| | | | |
|---|---|---|---|
| 1032466 | 6/1958 | Germany | 416/100 |

*Primary Examiner*—F. Daniel Lopez
*Assistant Examiner*—Matthew T. Shanley
*Attorney, Agent, or Firm*—Christensen O'Connor Johnson & Kindness PLLC

[57] ABSTRACT

A fan apparatus includes a housing with front and rear parts and two swivel joints, a driving motor disposed in the housing, inner and outer annular members, a transmission member, and an anchoring member. The motor has a rear portion provided with a worm section extending toward the rear part. The inner annular member is sleeved on the front part and is connected to the joints so as to swivel relative to the latter. The outer annular member is sleeved retainingly on the inner annular member and is angularly adjustable relative to the same. A swing rod has a first proximate end relative to the worm section and mounted pivotally on the rear part, and a first distal end which extends toward the front part. The transmission member is disposed in the rear part to transmit an axial rotation of the worm section to swing the first distal end of the swing rod relative to the first proximate end in a plane parallel to the worm section. The anchoring member has a second proximate end mounted pivotally on the inner annular member and a second distal end fixedly anchored on the first distal end of the swing rod to arrest movement of the second distal end, thereby driving the first proximate end as well as the rear part to swing around the swivel joints.

8 Claims, 11 Drawing Sheets

ELECTRIC FAN APPARATUS CAPABLE OF BLOWING AIR IN A DESIRED ORIENTATION

FIELD OF THE INVENTION

This invention relates to an electric fan apparatus, more particularly to an electric fan apparatus capable of blowing air in a desired orientation.

DESCRIPTION OF THE RELATED ART

A conventional fan apparatus includes a housing, a driving motor, a swing rod, a drive transmission member, an upright stand, and an impeller. The housing has front and rear parts which extend in a longitudinal direction, and a swivel joint formed on an outer circumference of the housing. The upright stand has an upper end connected fixedly to the swivel joint of the housing. The driving motor is disposed in the housing and is provided with an output spindle which has a front end portion projecting outwardly from the front part, and a rear end portion extending into the rear part. The rear end portion of the output spindle is provided with a worm section. The swing rod is disposed in the rear part of the housing and has a first proximate end relative to the worm section and connected pivotally to the rear part, and a first distal end which extends toward the front part. The drive transmission member is disposed in the rear part to transmit the axial rotation of the worm section to swing the first proximate end of the swing rod about the swivel joint in a plane parallel to the worm section of the output spindle. The impeller is mounted fixedly on the front end portion of the output spindle and is rotated by the driving motor.

It is noted that the swing action of the swing rod about the swivel joint results in the output spindle to blow air only to the left and right side directions of the upright stand, thereby limiting the air flow orientation.

SUMMARY OF THE INVENTION

The object of this invention is to provide an electric fan apparatus which can blow air in any desired orientation.

Accordingly, the electric fan apparatus of this invention includes a housing, a driving motor, a pair of swivel joints, an inner annular member, an outer annular member, a swing rod, a drive transmission member, an anchoring member, an upright stand and an impeller. The housing has a front part and a rear part which extend in a longitudinal direction. The driving motor is disposed in the housing, and has an output spindle with a front end portion which extends outwardly of the front part, and a rear end portion which extends toward the rear part. The rear end portion of the spindle is formed with a worm section. The swivel joints are formed on an outer circumference of the front part and are disposed diametrically opposite to each other in a transverse direction relative to the longitudinal direction. The inner annular member is sleeved on the outer circumference of the front part and is fixedly connected to the swivel joints at the opposite sides of the outer circumference so as to swivel relative to the outer circumference. The outer annular member is sleeved retainingly on the inner annular member in such a manner that the inner annular member is angularly adjustable relative to the outer annular member. The swing rod is disposed in the rear part of the housing, and has a first proximate end relative to the worm section and mounted pivotally on the rear part, and a first distal end which extends toward the front part. The drive transmission member is disposed in the rear part to transmit an axial rotation of the worm section to swing the first proximate end of the swing rod relative to the swivel joints in a plane parallel to the worm section. The anchoring member has a second proximate end mounted pivotally on the inner annular member and a second distal end which is anchored fixedly on the first distal end of the swing rod to arrest movement of the second distal end, thereby driving the first proximate end as well as the rear part of the housing to swing around the swivel joints. The upright stand includes an upper end connected fixedly to an outer periphery of the outer annular member. The impeller is mounted fixedly on the front end portion of the output spindle so as to be driven to rotate by the driving motor.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
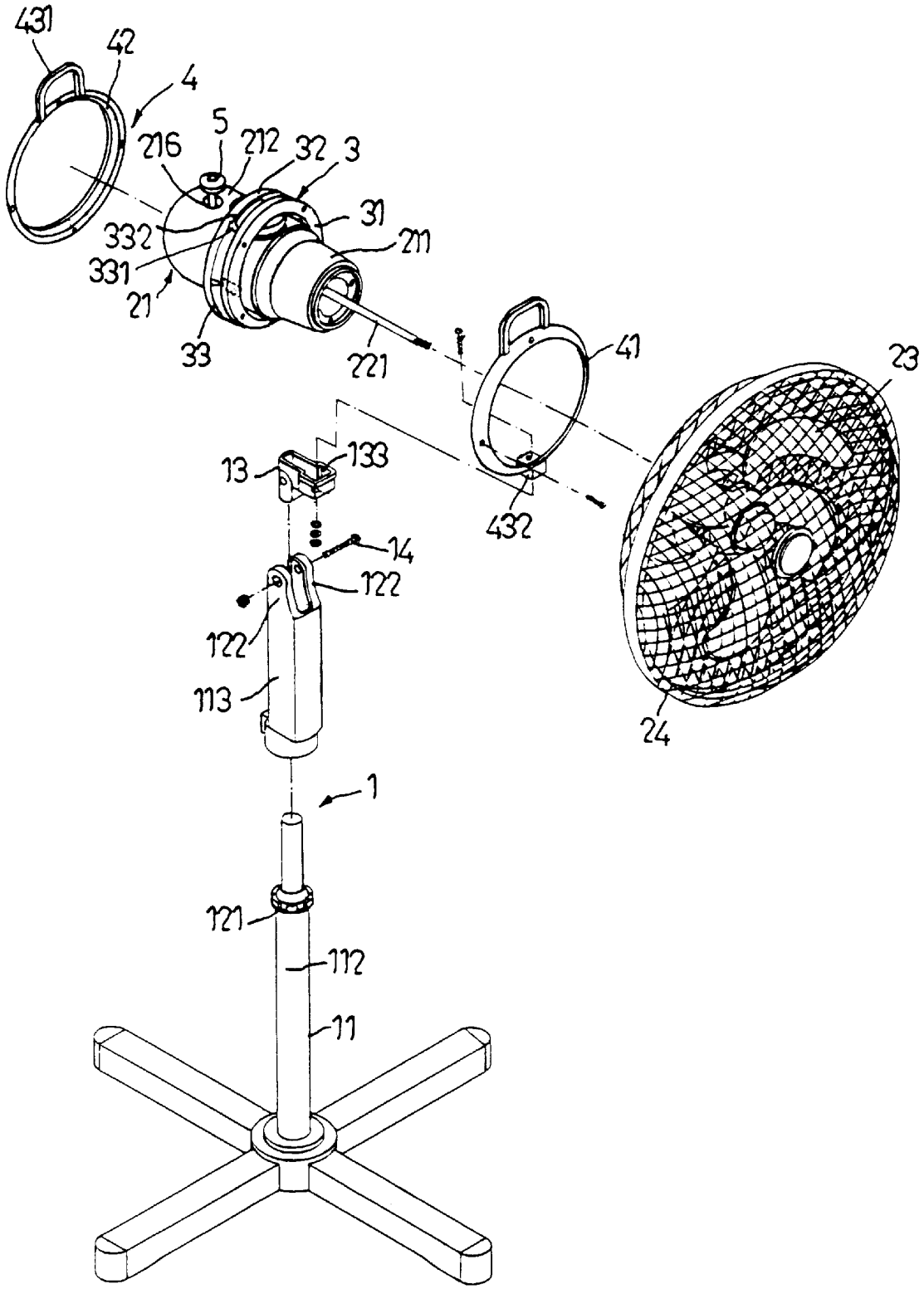
FIG. 1 is an exploded view of a preferred embodiment of an electric fan apparatus of this invention.
Figure 2:
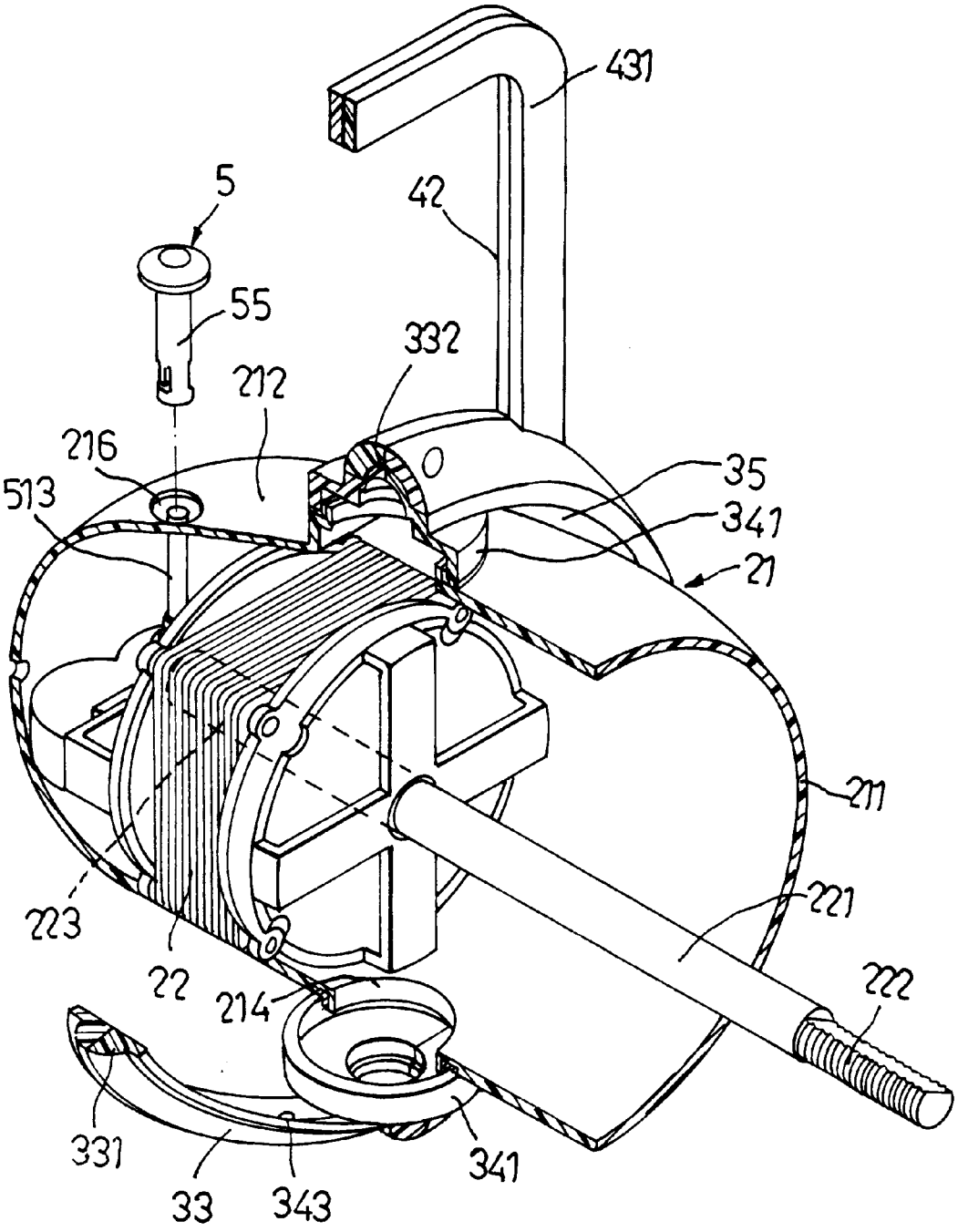
FIG. 2 is a fragmentary cutaway view illustrating the interior of the preferred embodiment.
Figure 3:
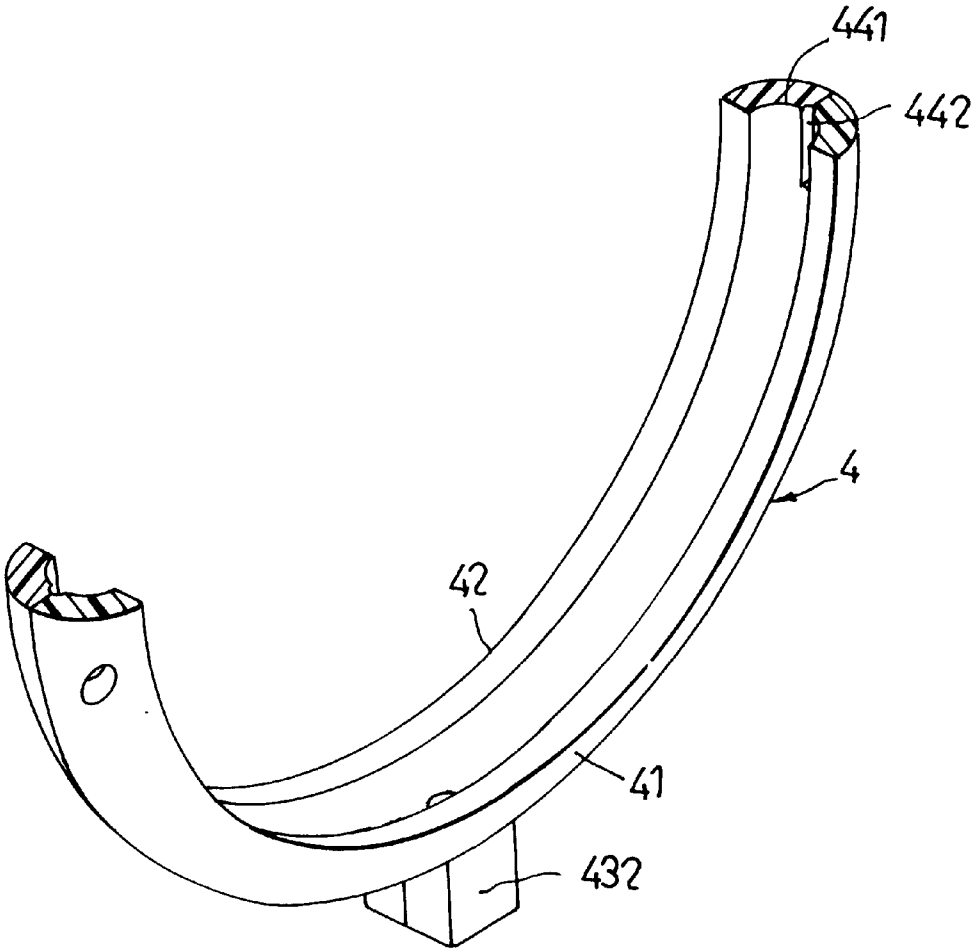
FIG. 3 is a sectional view of an outer annular member employed in the preferred embodiment.

Referring to FIGS. 1,2 and 3, the first preferred embodiment of an electric fan apparatus 1 of this invention is shown to include a tubular housing 21, a driving motor 22, a pair of swivel joints, an inner annular member 3, an outer annular member 4, a drive transmission member 5, an anchoring member, an upright stand 11, and an impeller 23.

As illustrated, the housing 21 has a front part 211 and a rear part 212 which extend in a longitudinal direction.

The driving motor 22 is disposed in the housing 21 and is provided with an output spindle 221. The output spindle 221 has a front end portion 222 which extends outwardly of the front part 211 such that the impeller 23 can be mounted thereon. The impeller 23 is generally covered by a netted rigid safety web 24. The rear end portion of the output spindle 221 is provided with a worm section 223 which extends into the rear part 212 of the housing 21.

The housing 21 further has two pivot units 214 formed on an outer circumference thereof which are diametrically opposite to each other in a transverse direction relative to the longitudinal direction of the housing 21.

The inner annular member 3 is sleeved on the outer circumference of the housing 21, and has two pivot unit retainers which rotatably receive the pivot unit 214 of the housing 21 so as to serve as swivel joints 341. A clearance 35 is formed between the inner annular member 3 and the housing 21 to facilitate turning of the housing 21 relative to the inner annular member 3. Thus, the housing 21 can swivel about the swivel joints 341 of the inner annular member 3.

The outer annular member 4 is sleeved retainingly on the inner annular member 3 in such a manner that the inner annular member is angularly adjustable relative to the outer annular member. The outer annular member 4 will be described in greater detail hereinafter.

The swing rod 54 (see FIG. 4) is disposed in the rear part 212 of said housing 21, and has a first proximate end 541 relative to the worm section 223 and mounted pivotally on the rear part 212, and a first distal end 542 which extends towards the front part 211 of the housing 21.

The drive transmission member 5 is disposed in the rear part 212 to transmit an axial rotation of the worm section 223 to swing the first distal end 542 of the swing rod 54 relative to the first proximate end 541 in a plane parallel to the worm section 223.

The anchoring member 56 has a second proximate end 561 pivotally mounted in a retaining hole 343 of the inner annular member 3 offset relative to the swivel joints 341, and a second distal end 562 which is fixedly anchored on the first distal end 542 of the swing rod 54 via a hole 217 of the housing 21 to arrest movement of the second distal end 562, thereby driving the first proximate end 541 as well as the rear part 212 of the housing 21 to swing around the swivel joints 341.

The upright stand 11 includes a lower portion 112 and an upper portion 113 connected to a lower portion 432 of the outer annular member 4 by means of an inclination adjustable seat 13. The lower portion 432 of the outer annular member 4 extends into a vertical engagement hole 133 of the seat 13. The seat 13 is mounted between two upright lugs 122 of the upper portion 113 of the upright stand 11 by a pivot 14 such that the inclination of the housing 21 relative to a horizontal line can be adjusted. The upright stand 11 further has a height adjustment device 121 disposed between the lower and upper portions 112,113 thereof so as to adjust the height of the impeller 23 relative to the ground.

Figure 4:
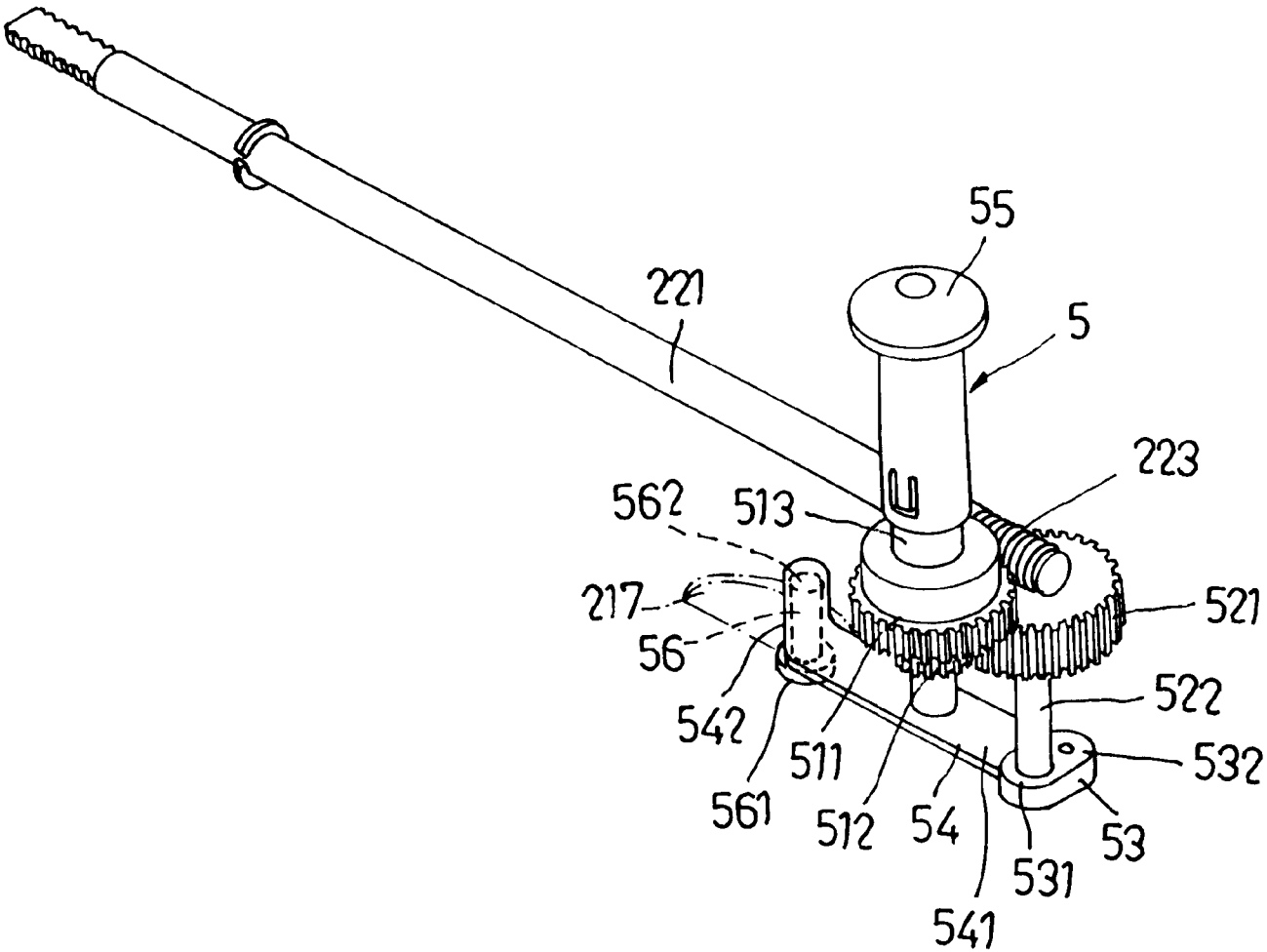
FIG. 4 illustrates a drive transmission member employed in the preferred embodiment.

As best shown in FIG. 4, in the first preferred embodiment, the drive transmission member 5 includes a first transmission wheel 511 meshing with the worm section 223 of the output spindle 221, a second transmission wheel 512 co-axially formed with the first transmission wheel 511, a third transmission wheel 521 meshing with the second transmission wheel 512 and provided with a fixed axle 522, and a connecting plate 53 disposed parallel to the first transmission wheel 511 and transverse to an axis of the first transmission wheel 511. The connecting plate 53 is fixed to the axle 522 at one end 531 and has an opposite end 532 connected pivotally to the first proximate end 541 of the swing rod 54. The drive transmission member 5 further includes a shaft 513 which is coaxially mounted to the first and second transmission wheels 511, 512, and a control knob 55 coupled to the shaft 513 to bring the second transmission wheel 512 into engagement with the third transmission wheel 521 so as to transmit the drive of the fixed axle 522 to swing the rear part 212 of the housing 21 relative to the swivel joints 341. A portion of the control knob 55 projects outwardly from a hole 216 formed in the rear part 212 of the housing 21. The control knob 55 is capable of being pulled outwardly and upwardly relative to the rear part 212 so as to disengage the second transmission wheel 512 from the third transmission wheel 521, thereby preventing swinging action of the rear part 212 relative to the swivel joints 341.

Referring again to FIGS. 1, 2 and 3, the outer annular member 4 has has a circumferential keyway 441 formed in an inner surface thereof, an inverted U-shaped grip portion 431 formed on an uppermost portion to facilitate shifting of the fan apparatus, and a dent 442 at midway of the keyway 441. The inner annular member 3 includes a key 331 formed on the outer circumferential surface 33 to slide along the keyway 441 for relative angular adjustment between the inner and outer annular members 3, 4. In this preferred embodiment, the inner and outer annular members 3, 4 are formed by front and rear halves (31,32), (41,42). The key 331 includes six spaced angular key sections to reduce friction when sliding on the keyway 441, and a protrusion 332 formed on one of the angular key sections for engagement in the dent 442.

Figure 5:
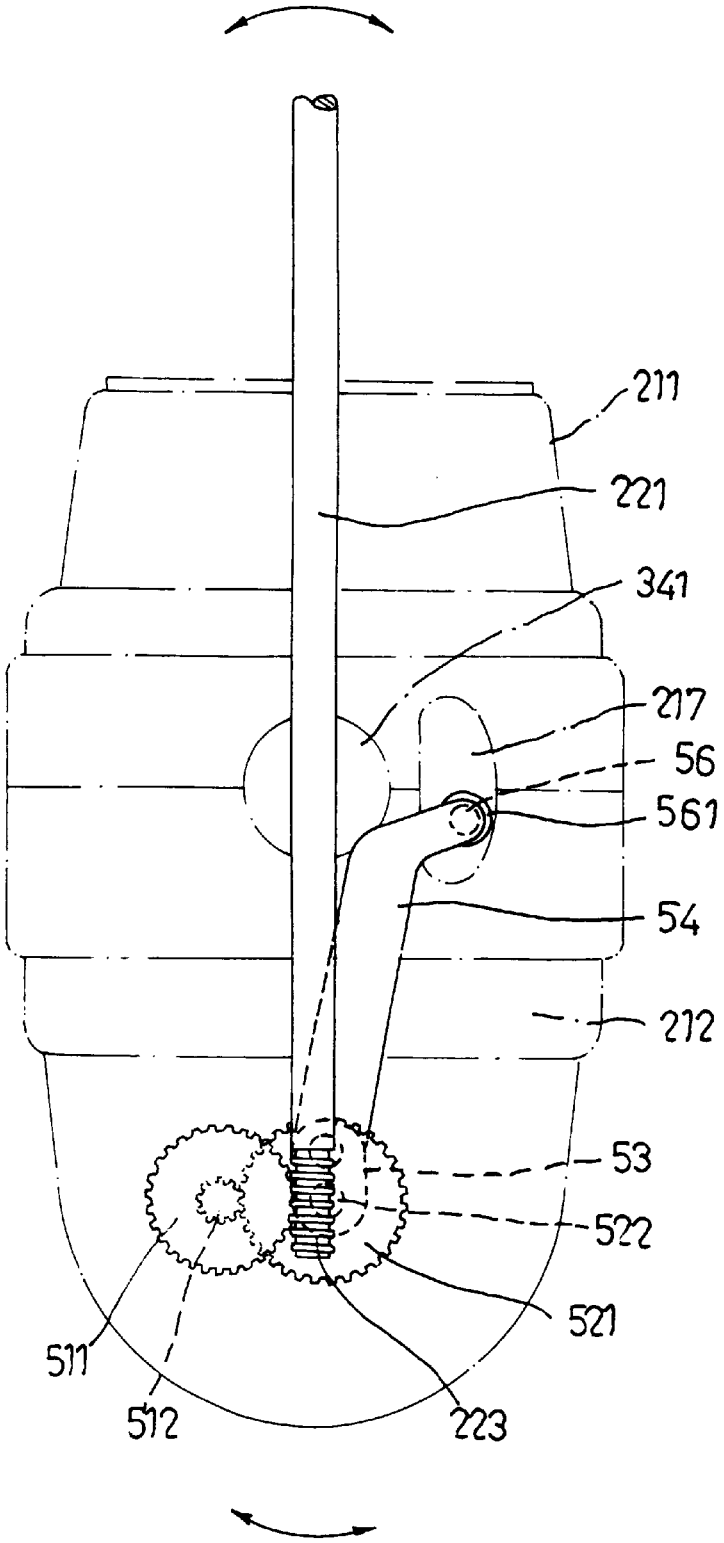
FIG. 5 illustrates how the preferred embodiment is moved to left and right directions by the transmission member shown in FIG. 4.
Figure 6:
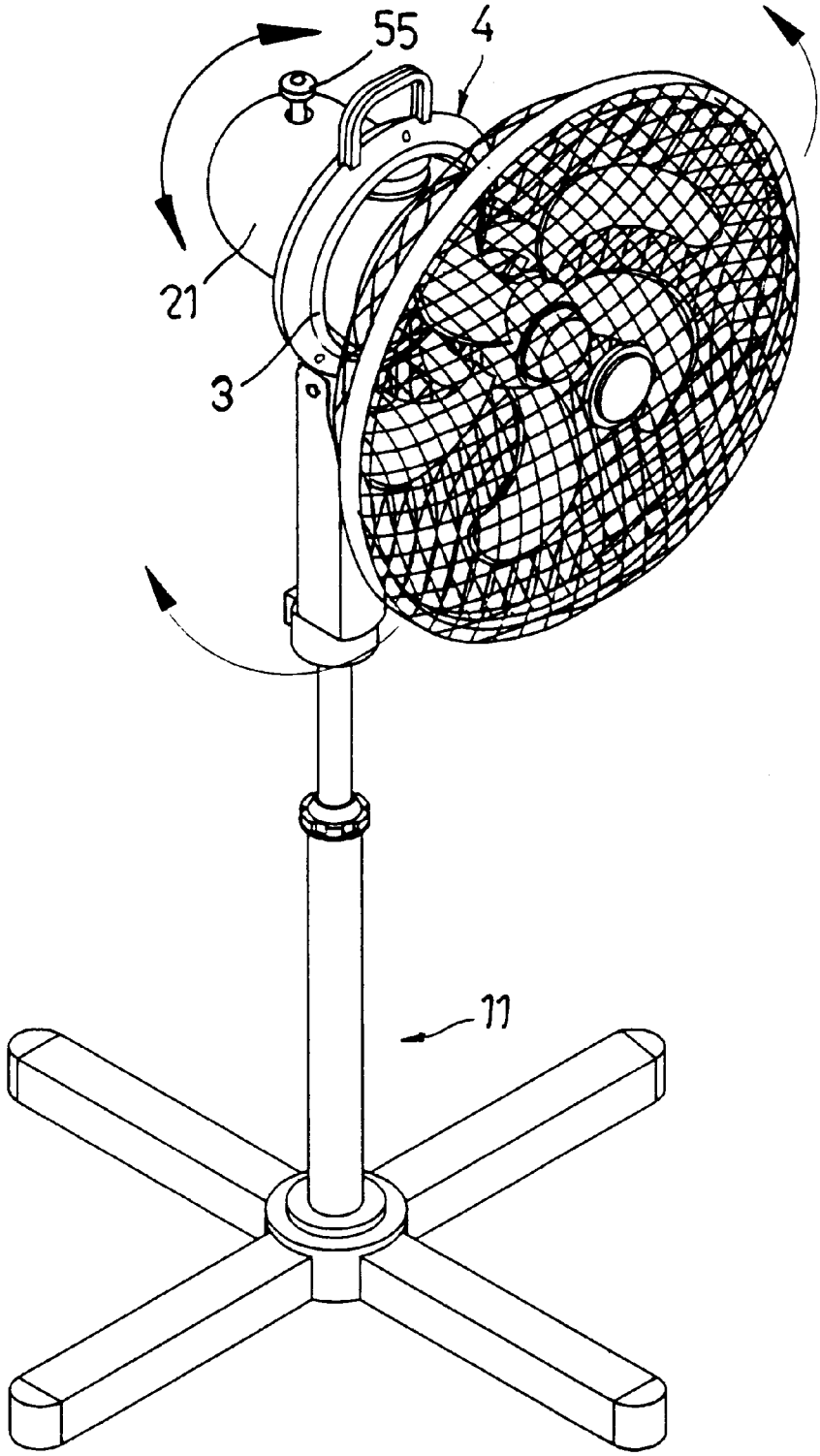
FIG. 6 shows the moving direction of the preferred embodiment at an initial position.

Referring to FIGS. 5 and 6, when the driving motor 22 (see FIG. 2) is actuated, the output spindle 221 will rotate about a longitudinal axis such that the axial rotation of the spindle 221 is synchronously converted into swing action of the swing rod 54. Since the swing action of the swing rod 54 is arrested by the anchoring member 56 (see FIG. 4), the housing 21 will rotate about the swivel joints 341 (see FIG. 3) of the inner annular member 3 to left and right directions of the upright stand 11 in order to blow air in the left and right directions. Under this condition, the swivel joints 341 of the inner annular member 3 are located along a vertical line L parallel to the upright stand 11 (see FIG. 7).

Figure 7:
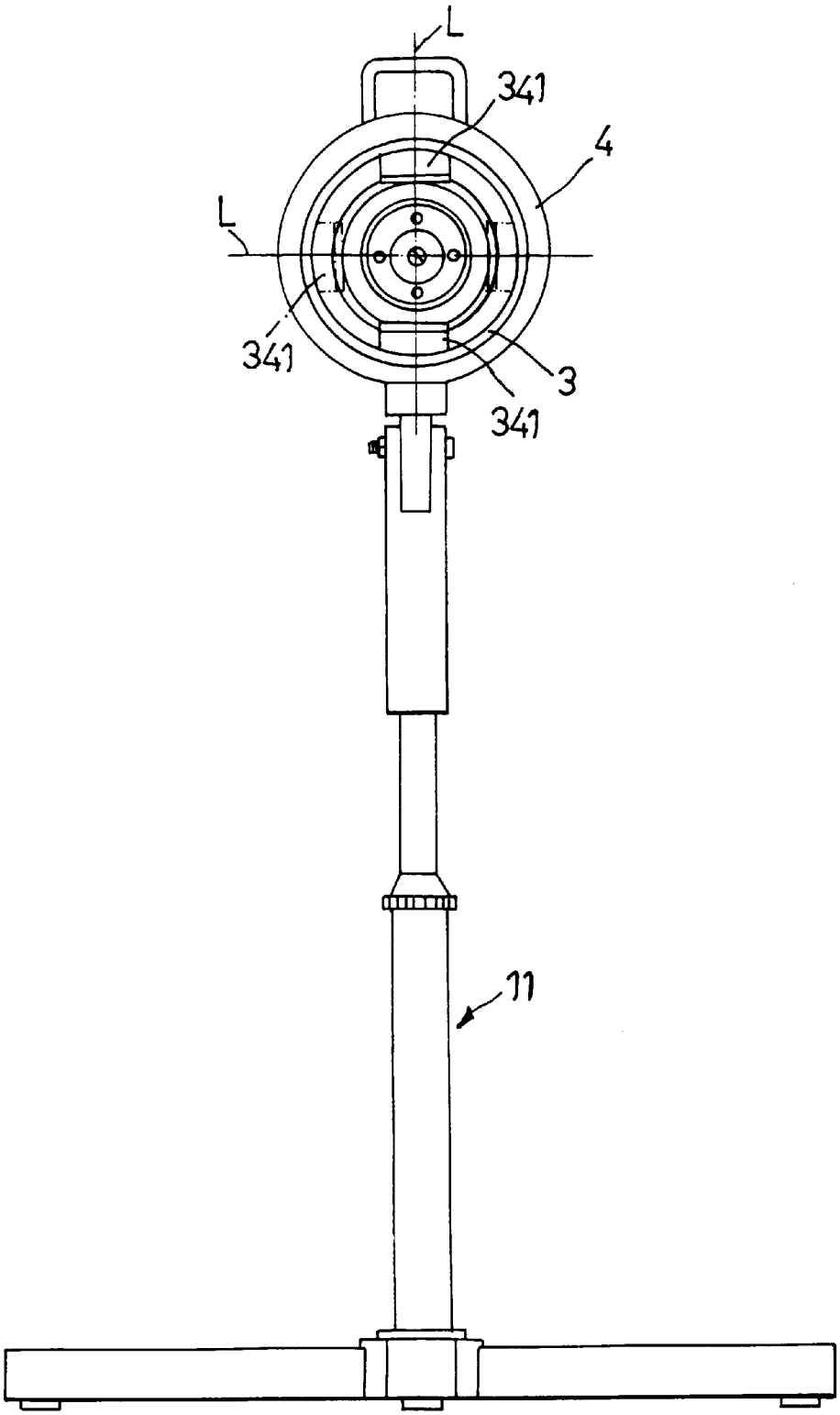
FIG. 7 illustrates the position of an inner annular member of the preferred embodiment after being angularly adjusted relative to the outer annular member shown in FIG. 3.
Figure 8:
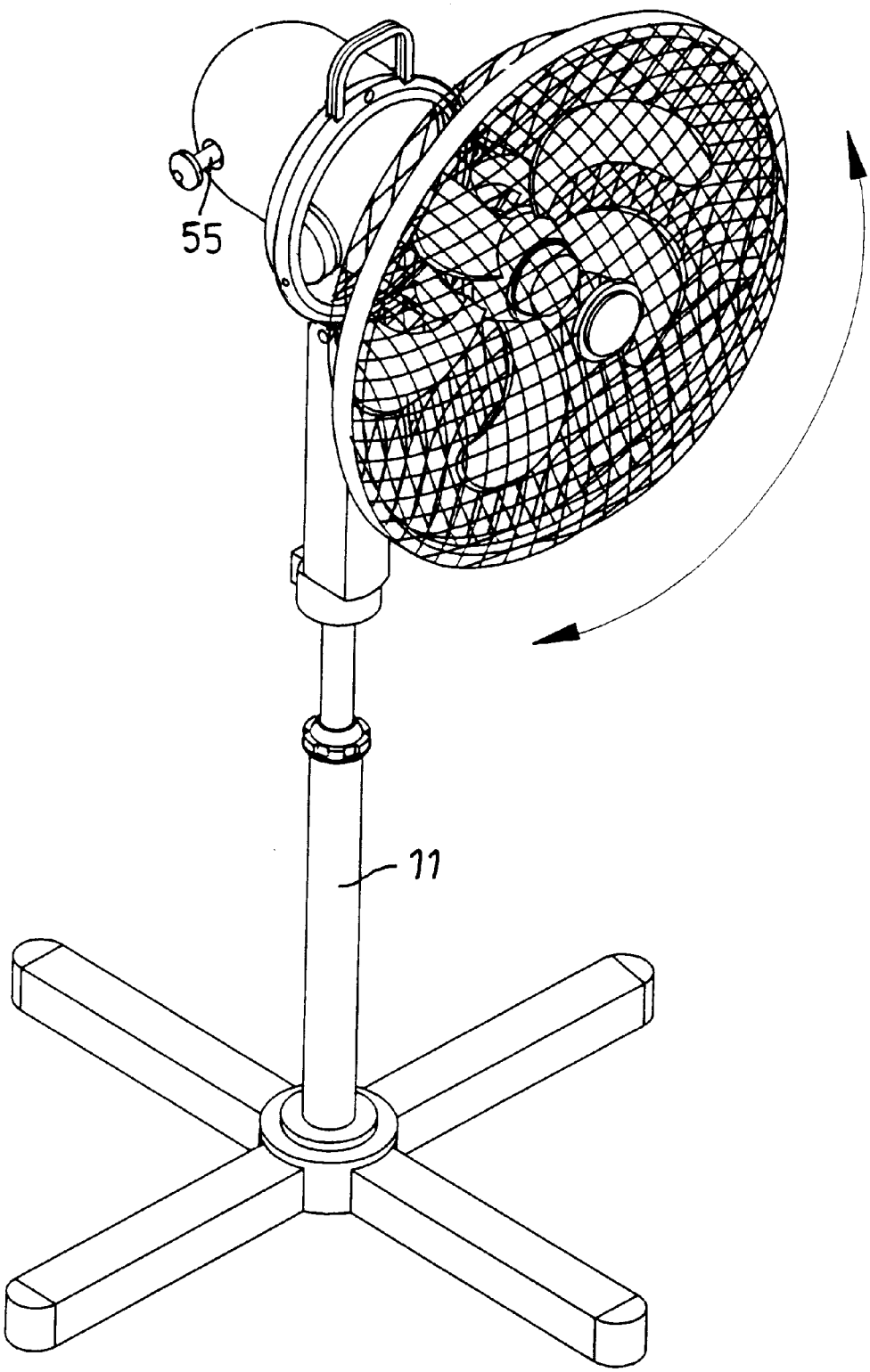
FIG. 8 illustrates the air blowing direction of the preferred embodiment after adjustment.

Referring to FIGS. 7 and 8, in case the user of the fan apparatus wishes the air to blow in up and down directions, he only needs to rotate the inner annular member 3 90 degrees relative to the outer annular member 4, wherein the protrusion 332 of the inner annular member 3 engages the dent 442 of the outer annular member 4 such that the swivel joints 341 are located along a horizontal line L transverse to the upright stand 11. Under this condition, the air will be blown in the up and down direction. In the same manner, the inner annular member 3 can be rotated any angular distance less than 90 degrees relative to the outer annular member 4 in order for the fan apparatus to blow air in any orientation.

Figure 9:
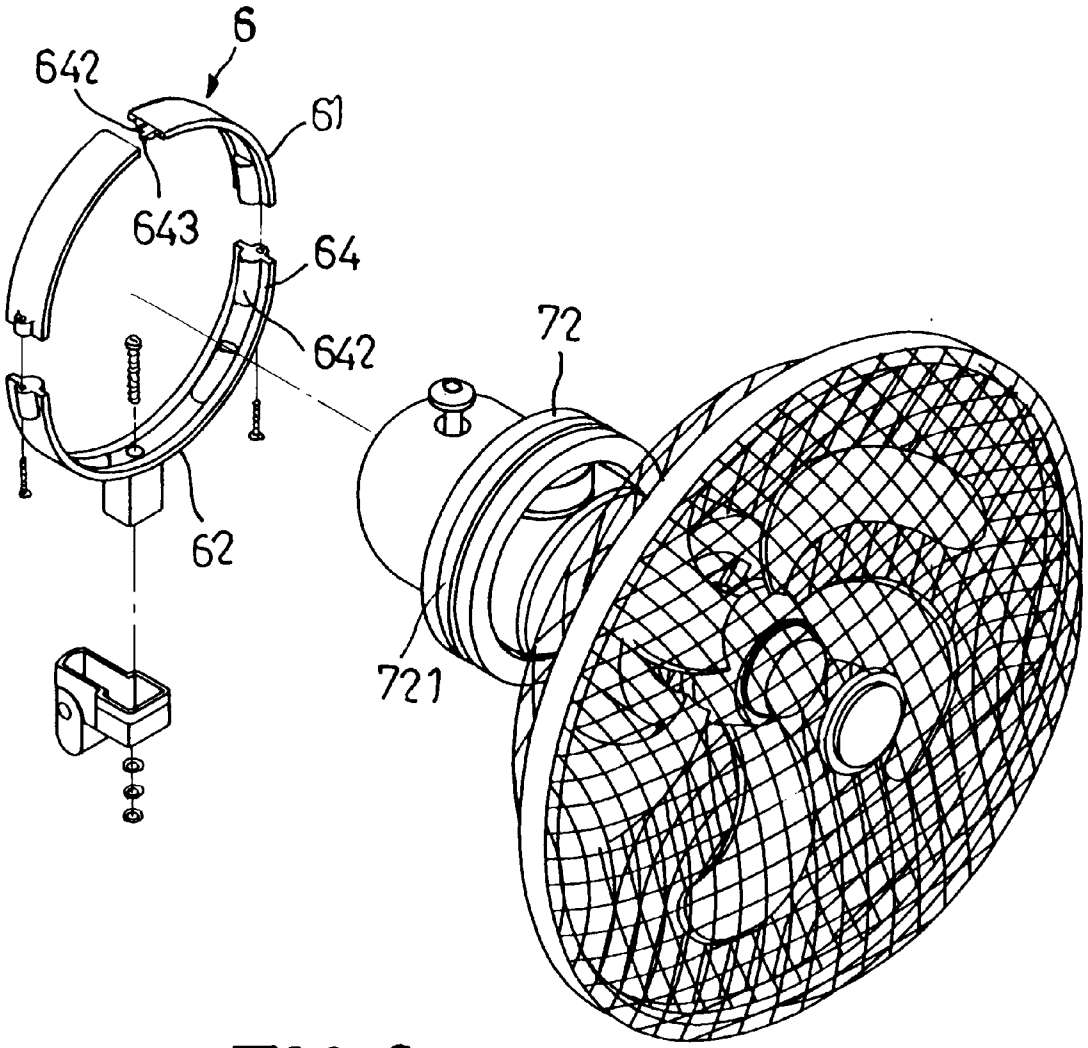
FIG. 9 is a partly exploded view of a second preferred embodiment of this invention.
Figure 10:
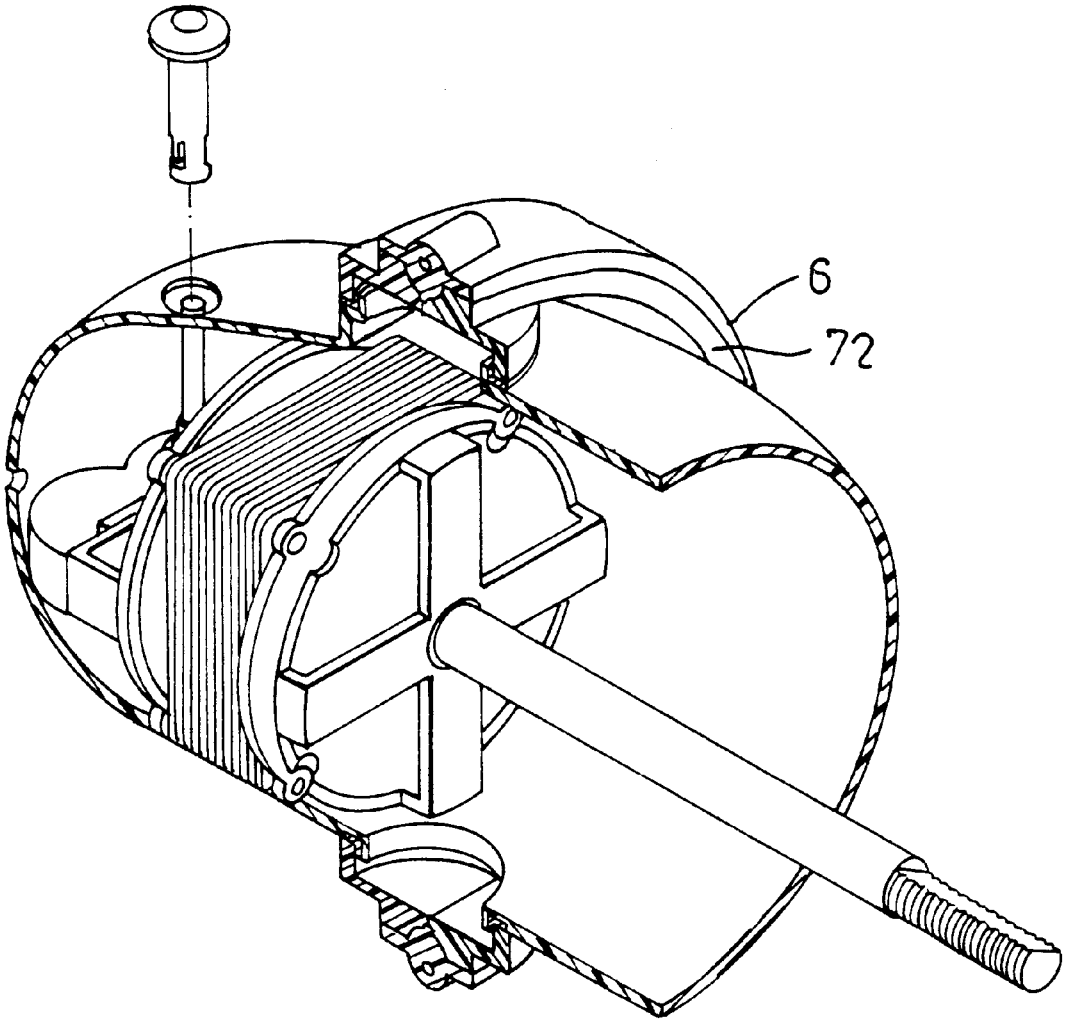
FIG. 10 is a fragmentary cutaway view illustrating the interior of the second preferred embodiment of this invention.

Referring to FIGS. 9 and 10, a second preferred embodiment of this invention is shown to have a structure similar to the previous embodiment except for the configuration of the outer annular member 6. The outer annular member 6 is formed by upper and lower halves 61, 62 and has a key 642 consisting of six spaced angular key sections 642 formed in an inner surface 64 thereof along a circumferential line and a protrusion 643 formed on one of the key sections. The inner annular member 72 has a keyway 721 with a structure that complements the key sections. The features and objects are the same as the previous embodiment.

Figure 11:
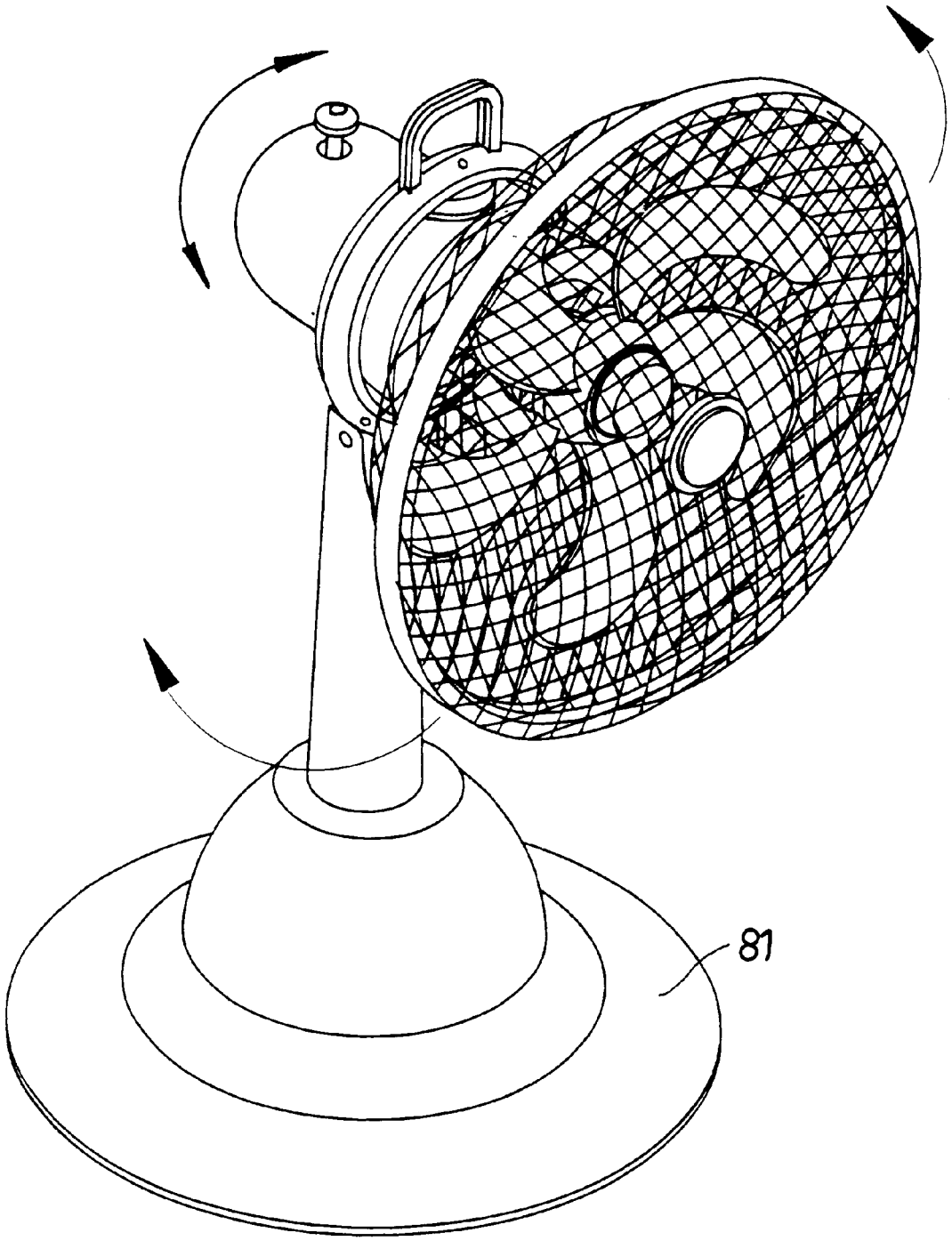
FIG. 11 illustrates the air blowing direction of the third preferred embodiment of this invention.

FIG. 11 shows a third preferred embodiment of this invention, wherein the upright stand 81 is relatively short so as to serve as a table fan.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. An electric fan apparatus, comprising:

a housing having a front part and a rear part which extend in a longitudinal direction;

a driving motor disposed in said housing and provided with an output spindle, said output spindle having a front end portion extending outwardly of said front part, and a rear end portion provided with a worm section which extends into said rear part;

a pair of swivel joints respectively disposed on an outer circumference of said front part and diametrically opposite to each other in a transverse direction relative to said longitudinal direction;

an inner annular member sleeved on said outer circumference of said front part, and fixedly connected to said swivel joints at opposite sides of said outer circumference so as to swivel relative to said outer circumference;

an outer annular member sleeved retainingly on said inner annular member in such a manner that said inner annular member is angularly adjustable relative to said outer annular member;

a swing rod disposed in said rear part of said housing, said swing rod having a first proximate end relative to said worm section and mounted pivotally on said rear part, and a first distal end extending towards said front part;

a drive transmission member disposed in said rear part to transmit an axial rotation of said worm section to swing said first distal end of said swing rod relative to said first proximate end in a plane parallel to said worm section;

an anchoring member having a second proximate end pivotally mounted on said inner annular member and a second distal end fixedly anchoring said first distal end of said swing rod to arrest movement of said second distal end, thereby driving said first proximate end as well as said rear part to swing around said swivel joints;

an upright stand having an upper end connected fixedly to an outer periphery of said outer annular member; and an impeller fixedly mounted on said front end portion of said output spindle and rotated by said driving motor.

2. The electric fan apparatus as defined in claim 1, wherein said drive transmission member includes a first transmission wheel meshing with said worm section, a second transmission wheel co-axially formed with said first transmission wheel, a third transmission wheel meshing with said second transmission wheel and provided with a fixed axle, and a connecting plate disposed parallel to said first transmission wheel and transverse to an axis of said first transmission wheel, said connecting plate being fixed to said axle at one end and having an opposite end connected pivotally to said first proximate end of said swing rod.

3. The electric fan apparatus as defined in claim 2, wherein said drive transmission member further includes a shaft connected coaxially to said first and second transmission wheels, and a control knob coupled to said shaft to bring said second transmission wheel into engagement with said third transmission wheel so as to transmit the drive of said fixed axle to swing said rear part relative to said swivel joints.

4. The electric fan apparatus as defined in claim 1, wherein said outer annular member has a circumferential keyway formed in an inner surface thereof, said inner annular member including a key formed on an outer circumferential surface to slidably engage said keyway for relative angular adjustment between said inner and outer annular members.

5. The electric fan apparatus as defined in claim 4, wherein said key includes a plurality of key sections, each of which is spaced uniformly from one another along a circumferential line so as to reduce friction between said inner and outer annular members.

6. The electric apparatus as defined in claim 5, wherein said keyway of said outer annular member is formed with a dent, one of said key sections being provided with a protrusion to engage said dent when said inner annular member is rotated relative to said outer annular member, thereby limiting rotation of said inner annular member in said outer annular member.

7. The electric fan apparatus as defined in claim 4, wherein each of said inner and outer annular members is formed by front and rear halves.

8. The electric fan apparatus as defined in claim 4, wherein said outer annular member is formed by upper and lower halves which are mounted together.

* * * * *